US008561427B2

(12) United States Patent
Knight et al.

(10) Patent No.: US 8,561,427 B2
(45) Date of Patent: Oct. 22, 2013

(54) MULTI-SLAB MULTICHANNEL HEAT EXCHANGER

(75) Inventors: John T. Knight, Norman, OK (US); William L. Kopko, Jacobus, PA (US); Stephen B. Pickle, Norman, OK (US); Jose Ruel Yalung de la Cruz, Dover, PA (US); Tony Clive Coleman, Swanley (GB); Mahesh Valiya-Naduvath, Lutherville, MD (US)

(73) Assignee: Johnson Controls Technology Company, Holland, MI (US)

( * ) Notice: Subject to any disclaimer, the term of this patent is extended or adjusted under 35 U.S.C. 154(b) by 191 days.

(21) Appl. No.: 13/088,932

(22) Filed: Apr. 18, 2011

(65) Prior Publication Data

US 2011/0192582 A1 Aug. 11, 2011

Related U.S. Application Data

(63) Continuation of application No. 12/200,504, filed on Aug. 28, 2008, now Pat. No. 7,942,020, which is a continuation of application No. PCT/US2008/071217, filed on Jul. 25, 2008.

(60) Provisional application No. 60/952,280, filed on Jul. 27, 2007.

(51) Int. Cl.
*F25B 39/02* (2006.01)

(52) U.S. Cl.
USPC ..... 62/519; 62/524

(58) Field of Classification Search
USPC ..... 62/509, 515, 519, 524, 527; 165/172, 165/173, 174, 175
See application file for complete search history.

(56) References Cited

U.S. PATENT DOCUMENTS

| | | | | |
|---|---|---|---|---|
| 3,229,722 | A * | 1/1966 | Kritzer | 138/39 |
| 5,168,925 | A | 12/1992 | Suzumura | |
| 5,327,959 | A | 7/1994 | Saperstein | |
| 5,479,985 | A | 1/1996 | Yamamoto et al. | |
| 5,765,393 | A | 6/1998 | Shlak et al. | |
| 5,901,785 | A | 5/1999 | Chiba | |
| 5,931,020 | A * | 8/1999 | Nakamura | 62/527 |
| 5,934,367 | A | 8/1999 | Shimmura | |
| 5,941,303 | A | 8/1999 | Gowan et al. | |
| 5,996,899 | A | 12/1999 | Watanabe et al. | |
| 6,199,401 | B1 | 3/2001 | Haussmann | |
| 6,276,443 | B1 | 8/2001 | Martin, Sr. | |
| 6,449,979 | B1 | 9/2002 | Nagasawa | |
| 6,516,486 | B1 * | 2/2003 | Mehendale et al. | 62/503 |

(Continued)

FOREIGN PATENT DOCUMENTS

| | | |
|---|---|---|
| DE | 102004044861 | 3/2006 |
| EP | 0654645 | 5/1995 |

(Continued)

*Primary Examiner* — Melvin Jones
(74) *Attorney, Agent, or Firm* — Fletcher Yoder, P.C.

(57) ABSTRACT

Heating, ventilation, air conditioning, and refrigeration (HVAC&R) systems and multi-slab heat exchangers are provided that include fluid connections for transmitting fluid between groups of tubes. The fluid connections may include generally tubular members fluidly connected to manifold sections. The fluid connections also may include partitioned manifolds containing tubes of different heights. Multichannel tubes are also provided that include a bent section configured to locate a flow path near a leading edge of a tube within one section and near a trailing edge of the tube within another section.

20 Claims, 6 Drawing Sheets

(56) References Cited

U.S. PATENT DOCUMENTS

| | | | | |
|---|---|---|---|---|
| 6,814,136 | B2 * | 11/2004 | Yi et al. | 165/153 |
| 6,868,696 | B2 | 3/2005 | Ikuta | |
| 6,964,296 | B2 | 11/2005 | Memory et al. | |
| 7,000,415 | B2 | 2/2006 | Daddis | |
| 7,044,200 | B2 | 5/2006 | Gupte | |
| 7,066,243 | B2 | 6/2006 | Horiuchi | |
| 7,107,787 | B2 | 9/2006 | Inaba | |
| 7,219,511 | B2 | 5/2007 | Inaba et al. | |
| 7,222,501 | B2 | 5/2007 | Cho | |
| 7,806,171 | B2 * | 10/2010 | Taras et al. | 165/174 |
| 2004/0206490 | A1 | 10/2004 | Katoh et al. | |
| 2008/0093062 | A1 | 4/2008 | Gorbounov et al. | |

FOREIGN PATENT DOCUMENTS

| | | |
|---|---|---|
| EP | 1426714 | 9/2004 |
| EP | 1640683 | 3/2006 |
| JP | 4187990 | 7/1992 |
| WO | WO 2004/020232 | 3/2004 |
| WO | WO 2006/083447 | 8/2006 |
| WO | WO 2006/083451 | 8/2006 |
| WO | WO 2006/083484 | 8/2006 |
| WO | WO 2007/037670 | 4/2007 |
| WO | WO 2007/129851 | 11/2007 |
| WO | WO 2008/038948 | 4/2008 |
| WO | WO 2008/060270 | 5/2008 |

* cited by examiner

FIG. 1
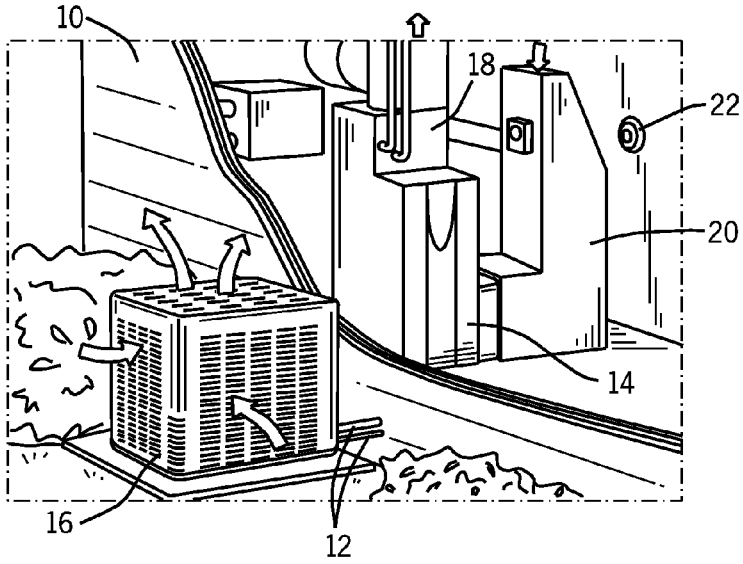
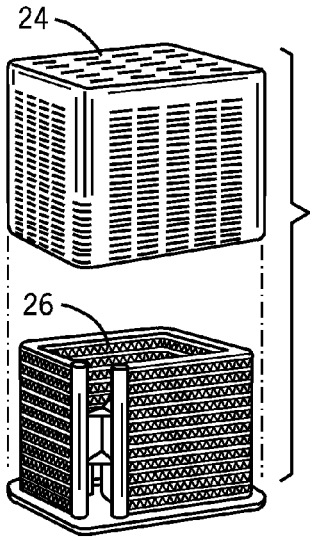
FIG. 2
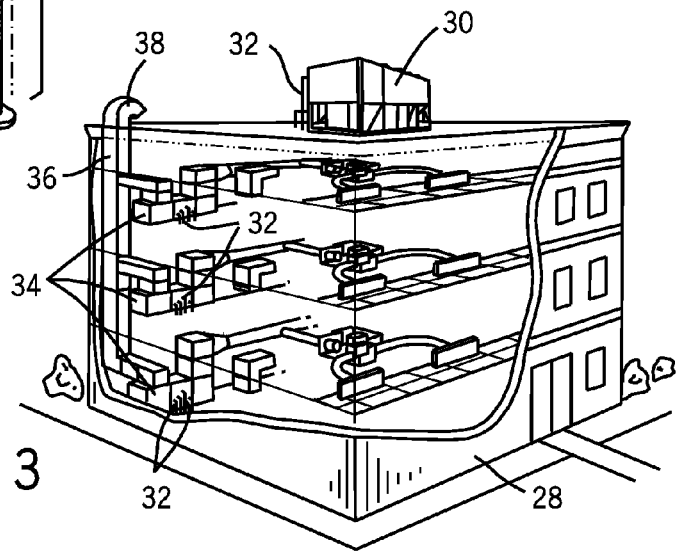
FIG. 3

FIG. 6
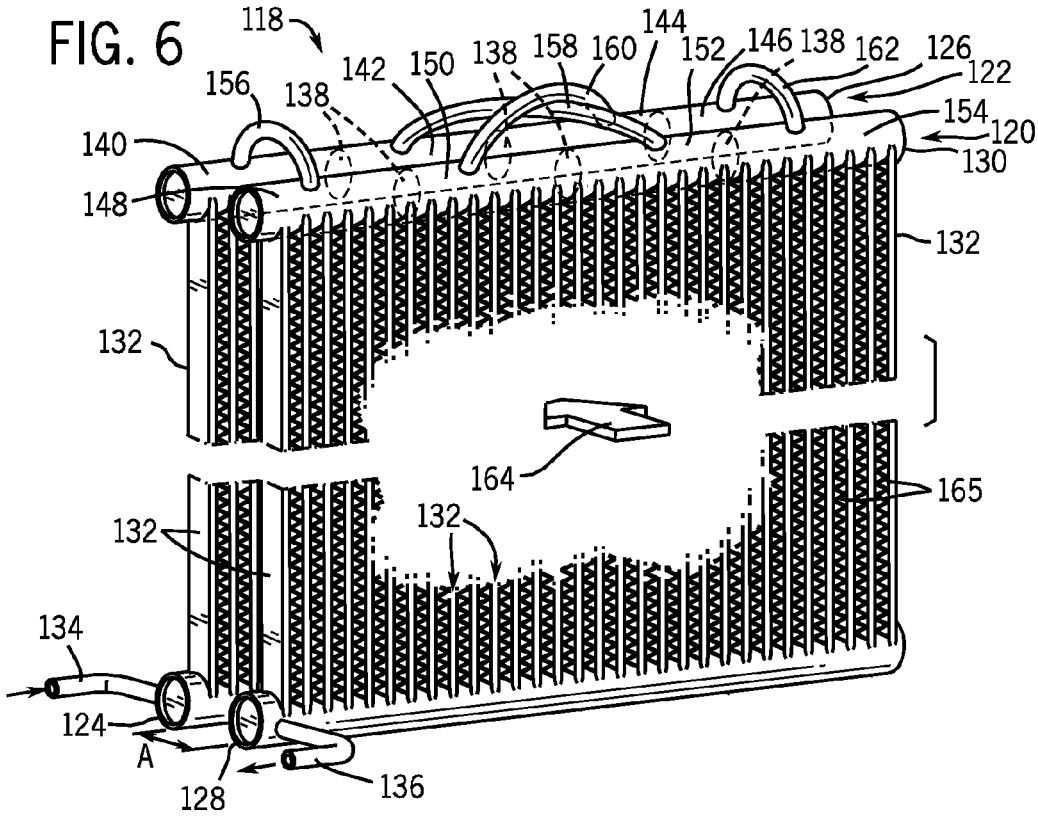
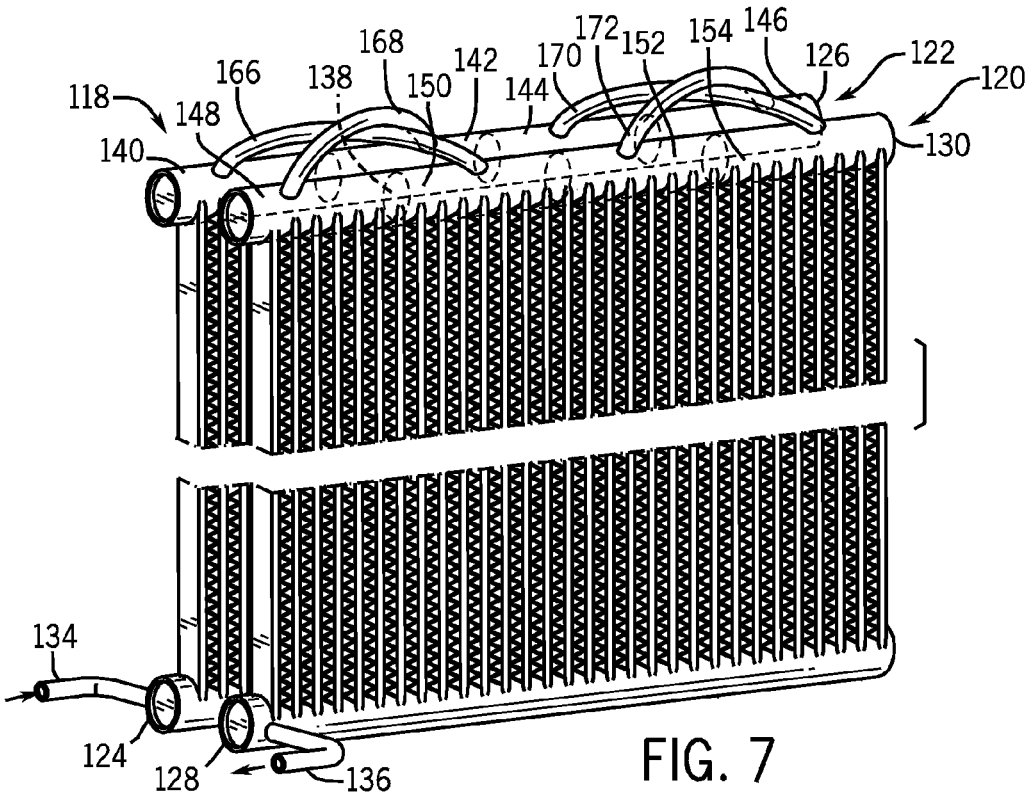
FIG. 7

FIG. 8
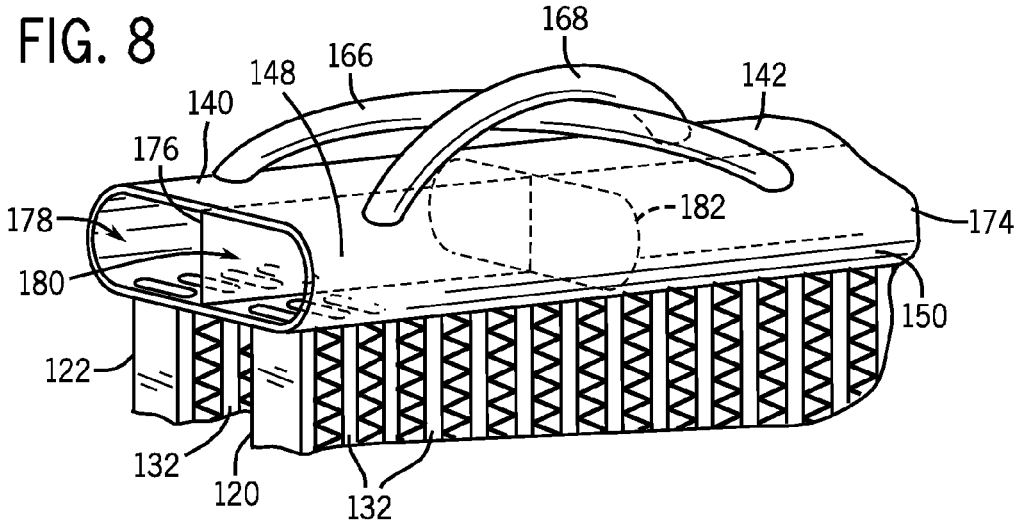
FIG. 9
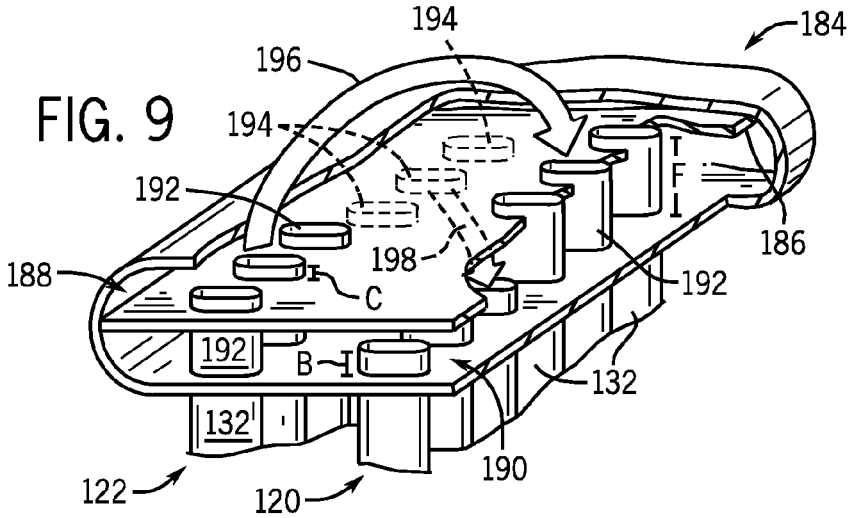
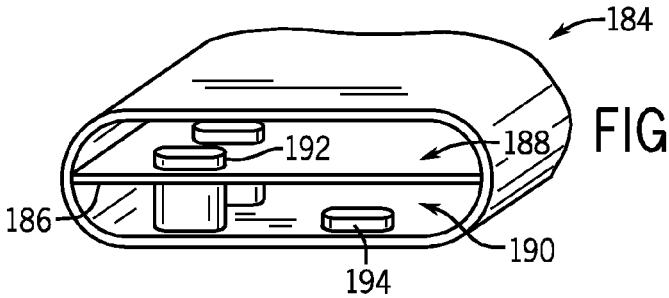
FIG. 10
FIG. 11
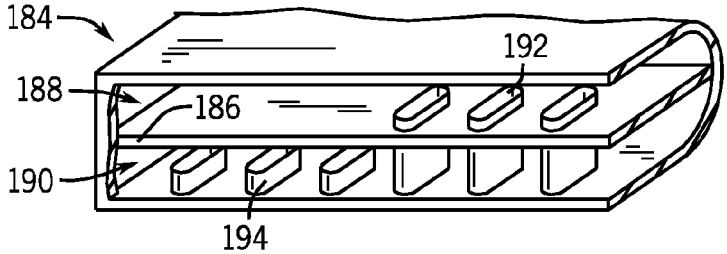

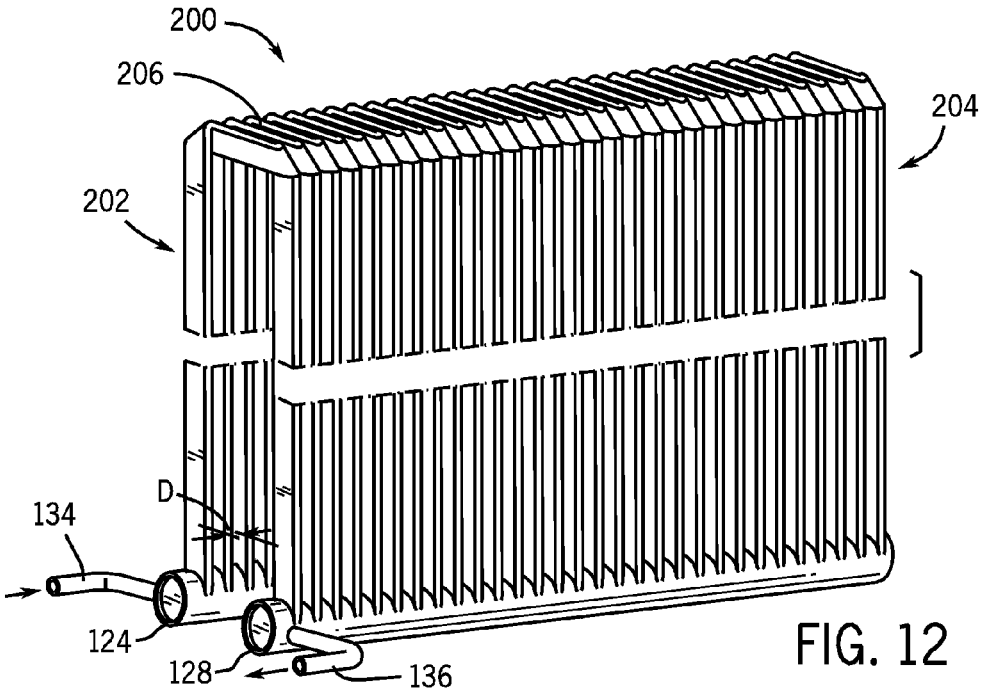
FIG. 12
FIG. 13
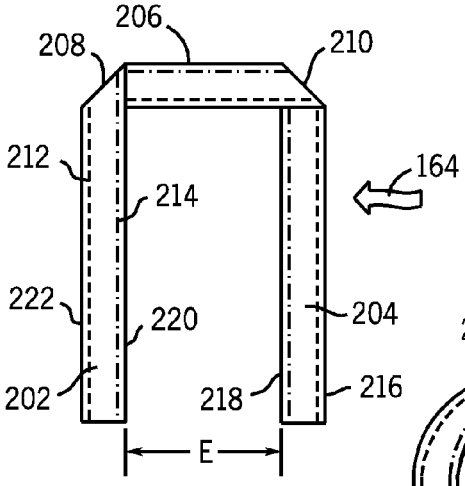
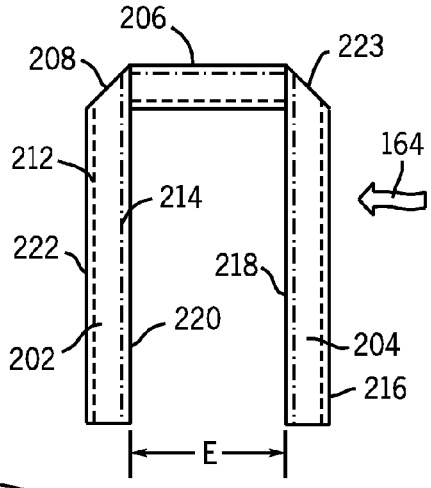
FIG. 14
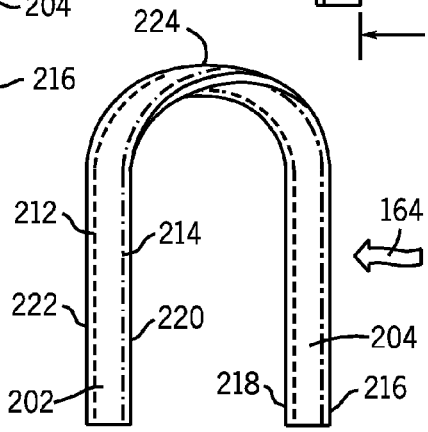
FIG. 15

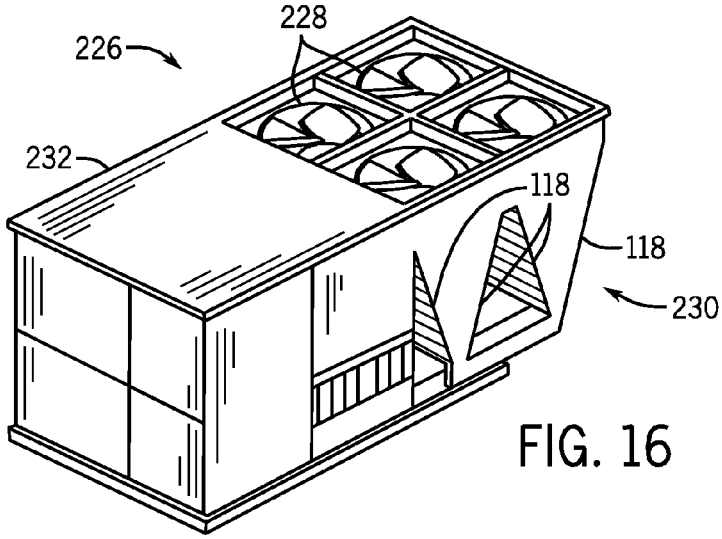
FIG. 16
FIG. 17
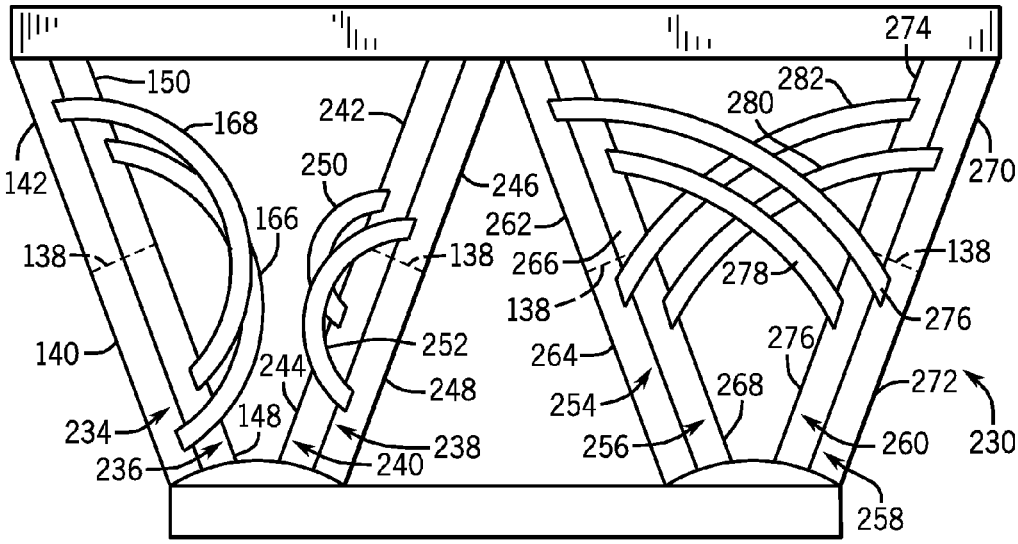
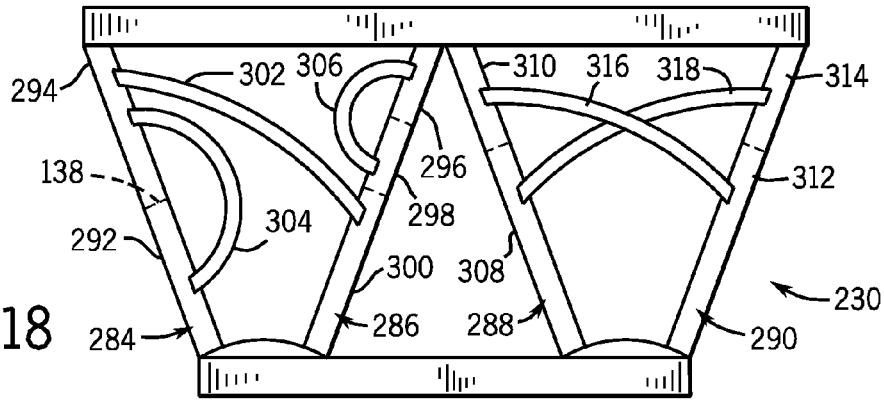
FIG. 18

MULTI-SLAB MULTICHANNEL HEAT EXCHANGER

CROSS REFERENCE TO RELATED APPLICATIONS

This application is a continuation of prior application Ser. No. 12/200,504, filed Aug. 28, 2008, entitled "MULTI-SLAB MUTLICHANNEL HEAT EXCHANGER", which is a continuation of International Application PCT/US2008/071217, filed Jul. 25, 2008, which claims priority from and the benefit of U.S. Provisional Application Ser. No. 60/952,280, entitled "MICROCHANNEL HEAT EXCHANGER APPLICATIONS", filed Jul. 27, 2007, which are hereby incorporated by reference.

BACKGROUND

The invention relates generally to multi-slab multichannel heat exchangers.

Heat exchangers are used in heating, ventilation, air conditioning, and refrigeration (HVAC&R) systems. Multichannel heat exchangers generally include multichannel tubes for flowing refrigerant through the heat exchanger. Each multichannel tube may contain several individual flow channels. Fins may be positioned between the tubes to facilitate heat transfer between refrigerant contained within the tube flow channels and external air passing over the tubes. Multichannel heat exchangers may be used in small tonnage systems, such as residential systems, or in large tonnage systems, such as industrial chiller systems.

In general, heat exchangers transfer heat by circulating a refrigerant through a cycle of evaporation and condensation. The rate of heat transfer may be affected by the location of a multichannel tube within a heat exchanger. For example, in a heat exchanger containing horizontal tubes, the bottom tubes may receive less airflow than the top tubes, resulting in a lower rate of heat transfer between the bottom tubes and the environment. In a heat exchanger containing vertical tubes, the outer tubes may receive less airflow based on proximity to other equipment or an outer wall. Further, multichannel heat exchangers may be placed in multi-slab configurations to provide increased capacity within a small equipment footprint. For example, two slabs of heat exchanger tubes may be placed side-by-side. In a multi-slab configuration, the outer heat exchanger coils may receive more airflow, resulting in a higher rate of heat transfer between these tubes and the environment.

SUMMARY

The present invention relates to a multi-slab heat exchanger with a first slab of multichannel tubes arranged generally in a first plane and a second slab of multichannel tubes arranged generally in a second plane parallel and adjacent to the first plane. The first slab is subdivided into a first group of tubes and a second group of tubes, and the second slab is subdivided into a third group of tubes aligned generally with the first group of tubes and a fourth group of tubes aligned generally with the second group of tubes. The heat exchanger also includes a fluid connection for transmitting fluid from the first group to the third group.

The present invention also relates to a multi-slab heat exchanger with a first manifold arranged generally in a first plane, a second manifold adjacent to the first manifold and arranged generally in a second plane parallel to the first plane, and a plurality of multichannel tubes in fluid communication with the first and second manifolds. Each of the multichannel tubes include a plurality of flow paths that have a first portion disposed in the first plane and a second portion disposed in the second plane. At least one of the multichannel tubes has a portion extending between the first and second planes.

The present invention further relates to systems and methods employing the multi-slab heat exchangers.

DRAWINGS

FIG. 1 is perspective view of an exemplary residential air conditioning or heat pump system of the type that might employ a heat exchanger.

FIG. 2 is a partially exploded view of the outside unit of the system of FIG. 1, with an upper assembly lifted to expose certain of the system components.

FIG. 3 is a perspective view of an exemplary commercial or industrial HVAC&R system that employs a chiller and air handlers to cool a building and that may also employ heat exchangers.

FIG. 6 is a perspective view of an exemplary multi-slab heat exchanger containing multichannel tubes.

FIG. 7 is a perspective view of another exemplary multi-slab heat exchanger containing multichannel tubes.

FIG. 8 is a perspective view of a manifold and tube configuration that might be used in a multi-slab multichannel heat exchanger.

FIG. 9 is a detailed perspective view of another manifold and tube configuration that might be used in a multi-slab heat exchanger, with a portion of the manifold cut away.

FIG. 10 is a detail perspective view of the manifold and tube configuration shown in FIG. 9.

FIG. 11 is a detailed perspective view of the manifold and tube configuration shown in FIG. 9 sectioned through the manifold.

FIG. 12 is a detailed perspective view of an exemplary multi-slab heat exchanger.

FIG. 13 is a front view of an exemplary multichannel tube that may be used in the heat exchanger of FIG. 12.

FIG. 14 is a front view of another exemplary multichannel tube that may be used in the heat exchanger of FIG. 12.

FIG. 15 is a front view of another exemplary multichannel tube that may be used in the heat exchanger of FIG. 12.

FIG. 16 is a perspective view of an exemplary chiller system that may employ one or more multi-slab heat exchangers.

FIG. 17 is a detailed view of the multi-slab heat exchanger configuration shown in FIG. 16.

FIG. 18 is a detailed view of an alternate configuration for multi-slab heat exchangers that may be used in the chiller system shown in FIG. 16.

DETAILED DESCRIPTION

Figure 4:
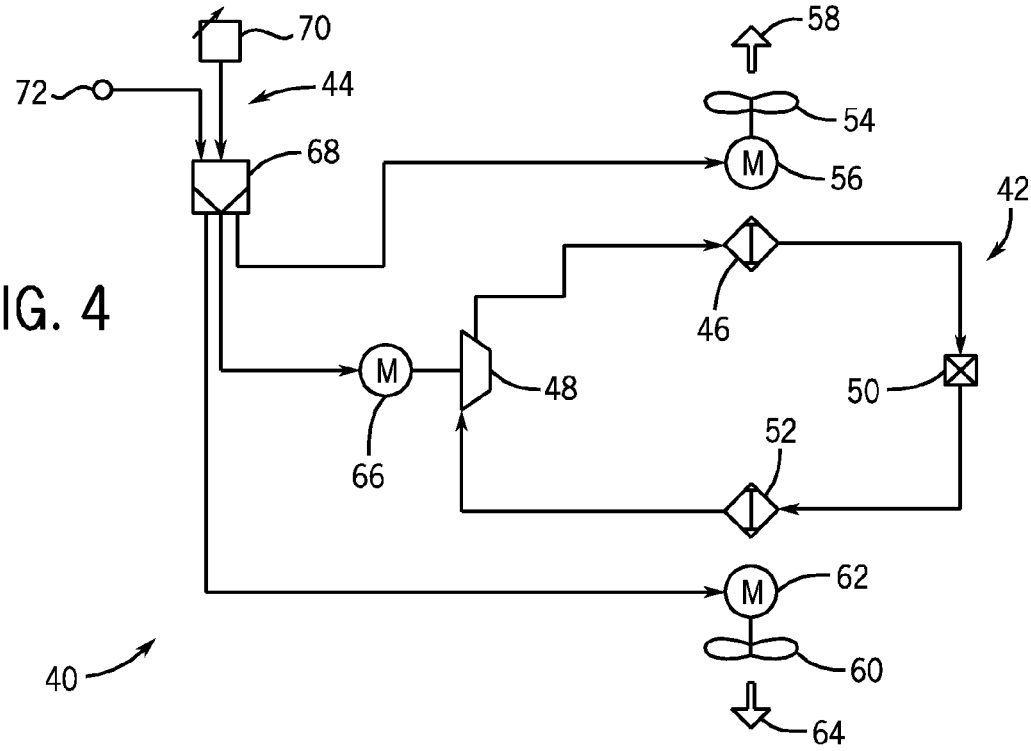
FIG. 4 is a diagrammatical overview of an exemplary air conditioning system that may employ one or more heat exchangers.

FIGS. 1 through 3 depict exemplary applications for heat exchangers. Such systems, in general, may be applied in a range of settings, both within the HVAC&R field and outside of that field. In presently contemplated applications, however, heat exchangers may be used in residential, commercial, light industrial, industrial, and in any other application for heating or cooling a volume or enclosure, such as a residence, building, structure, and so forth. Moreover, the heat exchangers may be used in industrial applications, where appropriate, for basic refrigeration and heating of various fluids. FIG. 1 illustrates a residential heating and cooling system. In general, a residence 10, will include refrigerant conduits 12 that operatively couple an indoor unit 14 to an outdoor unit 16. Indoor unit 14 may be positioned in a utility room, an attic, a basement, or other location. Outdoor unit 16 is typically situated adjacent to a side of residence 10 and is covered by a shroud to protect the system components and to prevent leaves and other contaminants from entering the unit. Refrigerant conduits 12 transfer refrigerant between indoor unit 14 and outdoor unit 16, typically transferring primarily liquid refrigerant in one direction and primarily vaporized refrigerant in an opposite direction.

When the system shown in FIG. 1 is operating as an air conditioner, a coil in outdoor unit 16 serves as a condenser for recondensing vaporized refrigerant flowing from indoor unit 14 to outdoor unit 16 via one of the refrigerant conduits 12. In these applications, a coil of the indoor unit, designated by the reference numeral 18, serves as an evaporator coil. Evaporator coil 18 receives liquid refrigerant (which may be expanded by an expansion device, not shown) and evaporates the refrigerant before returning it to outdoor unit 16.

Outdoor unit 16 draws in environmental air through its sides as indicated by the arrows directed to the sides of the unit, forces the air through the outer unit coil by a means of a fan (not shown), and expels the air as indicated by the arrows above the outdoor unit. When operating as an air conditioner, the air is heated by the condenser coil within the outdoor unit and exits the top of the unit at a temperature higher than when it entered the sides. Air is blown over indoor coil 18 and is then circulated through residence 10 by means of ductwork 20, as indicated by the arrows entering and exiting ductwork 20. The overall system operates to maintain a desired temperature as set by a thermostat 22. When the temperature sensed inside the residence is higher than the set point on the thermostat (plus a small amount), the air conditioner will become operative to refrigerate additional air for circulation through the residence. When the temperature reaches the set point (minus a small amount), the unit will stop the refrigeration cycle temporarily.

When the unit in FIG. 1 operates as a heat pump, the roles of the coils are simply reversed. That is, the coil of outdoor unit 16 will serve as an evaporator to evaporate refrigerant and thereby cool air entering outdoor unit 16 as the air passes over the outdoor unit coil. Indoor coil 18 will receive a stream of air blown over it and will heat the air by condensing a refrigerant.

FIG. 2 illustrates a partially exploded view of one of the units shown in FIG. 1, in this case outdoor unit 16. In general, the unit may be thought of as including an upper assembly 24 made up of a shroud, a fan assembly, a fan drive motor, and so forth. In the illustration of FIG. 2, the fan and fan drive motor are not visible because they are hidden by the surrounding shroud. An outdoor coil 26 is housed within this shroud and is generally deposed to surround or at least partially surround other system components, such as a compressor, an expansion device, a control circuit.

FIG. 3 illustrates another exemplary application, in this case an HVAC&R system for building environmental management. A building 28 is cooled by a system that includes a chiller 30, which is typically disposed on or near the building, or in an equipment room or basement. Chiller 30 is an air-cooled device that implements a refrigeration cycle to cool water. The water is circulated to building 28 through water conduits 32. The water conduits are routed to air handlers 34 at individual floors or sections of the building. The air handlers are also coupled to ductwork 36 that is adapted to blow air from an outside intake 38.

Chiller 30, which includes heat exchangers for both evaporating and condensing a refrigerant as described above, cools water that is circulated to the air handlers. Air blown over additional coils that receive the water in the air handlers causes the water to increase in temperature and the circulated air to decrease in temperature. The cooled air is then routed to various locations in the building via additional ductwork. Ultimately, distribution of the air is routed to diffusers that deliver the cooled air to offices, apartments, hallways, and any other interior spaces within the building. In many applications, thermostats or other command devices (not shown in FIG. 3) will serve to control the flow of air through and from the individual air handlers and ductwork to maintain desired temperatures at various locations in the structure.

FIG. 4 illustrates an air conditioning system 40, which may employ multichannel tube heat exchangers. Refrigerant flows through system 40 within closed refrigeration loop 42. The refrigerant may be any fluid that absorbs and extracts heat. For example, the refrigerant may be hydrofluorocarbon (HFC) based R-410A, R-407, or R-134a, or it may be carbon dioxide (R-744) or ammonia (R-717). Air conditioning system 40 includes control devices 44 that enable the system to cool an environment to a prescribed temperature.

System 40 cools an environment by cycling refrigerant within closed refrigeration loop 42 through a condenser 46, a compressor 48, an expansion device 50, and an evaporator 52. The refrigerant enters condenser 46 as a high pressure and temperature vapor and flows through the multichannel tubes of the condenser. A fan 54, which is driven by a motor 56, draws air across the multichannel tubes. The fan may push or pull air across the tubes. As the air flows across the tubes, heat transfers from the refrigerant vapor to the air, producing heated air 58 and causing the refrigerant vapor to condense into a liquid. The liquid refrigerant then flows into an expansion device 50 where the refrigerant expands to become a low pressure and temperature liquid. Typically, expansion device 50 will be a thermal expansion valve (TXV); however, according to other exemplary embodiments, the expansion device may be an orifice or a capillary tube. After the refrigerant exits the expansion device, some vapor refrigerant may be present in addition to the liquid refrigerant.

From expansion device 50, the refrigerant enters evaporator 52 and flows through the evaporator multichannel tubes. A fan 60, which is driven by a motor 62, draws air across the multichannel tubes. As the air flows across the tubes, heat transfers from the air to the refrigerant liquid, producing cooled air 64 and causing the refrigerant liquid to boil into a vapor. According to certain embodiments, the fan may be replaced by a pump that draws fluid through the evaporator. The evaporator may be a shell-and-tube heat exchanger, brazed plate heat exchanger, or other suitable heat exchanger.

The refrigerant then flows to compressor 48 as a low pressure and temperature vapor. Compressor 48 reduces the volume available for the refrigerant vapor, consequently, increasing the pressure and temperature of the vapor refrigerant. The compressor may be any suitable compressor such as a screw compressor, reciprocating compressor, rotary compressor, swing link compressor, scroll compressor, or turbine compressor. Compressor 48 is driven by a motor 66 that receives power from a variable speed drive (VSD) or a direct AC or DC power source. According to an exemplary embodiment, motor 66 receives fixed line voltage and frequency from an AC power source although in certain applications the motor may be driven by a variable voltage or frequency drive. The motor may be a switched reluctance (SR) motor, an induction motor, an electronically commutated permanent magnet motor (ECM), or any other suitable motor type. The refrigerant exits compressor 48 as a high temperature and pressure vapor that is ready to enter the condenser and begin the refrigeration cycle again.

The control devices 44, which include control circuitry 68, an input device 70, and a temperature sensor 72, govern the operation of the refrigeration cycle. Control circuitry 68 is coupled to the motors 56, 62, and 66 that drive condenser fan 54, evaporator fan 60, and compressor 48, respectively. Control circuitry 68 uses information received from input device 70 and sensor 72 to determine when to operate the motors 56, 62, and 66 that drive the air conditioning system. In certain applications, the input device may be a conventional thermostat. However, the input device is not limited to thermostats, and more generally, any source of a fixed or changing set point may be employed. These may include local or remote command devices, computer systems and processors, and mechanical, electrical and electromechanical devices that manually or automatically set a temperature-related signal that the system receives. For example, in a residential air conditioning system, the input device may be a programmable 24-volt thermostat that provides a temperature set point to the control circuitry. Sensor 72 determines the ambient air temperature and provides the temperature to control circuitry 68. Control circuitry 68 then compares the temperature received from the sensor to the temperature set point received from the input device. If the temperature is higher than the set point, control circuitry 68 may turn on motors 56, 62, and 66 to run air conditioning system 40. The control circuitry may execute hardware or software control algorithms to regulate the air conditioning system. According to exemplary embodiments, the control circuitry may include an analog to digital (A/D) converter, a microprocessor, a nonvolatile memory, and an interface board. Other devices may, of course, be included in the system, such as additional pressure and/or temperature transducers or switches that sense temperatures and pressures of the refrigerant, the heat exchangers, the inlet and outlet air, and so forth.

Figure 5:
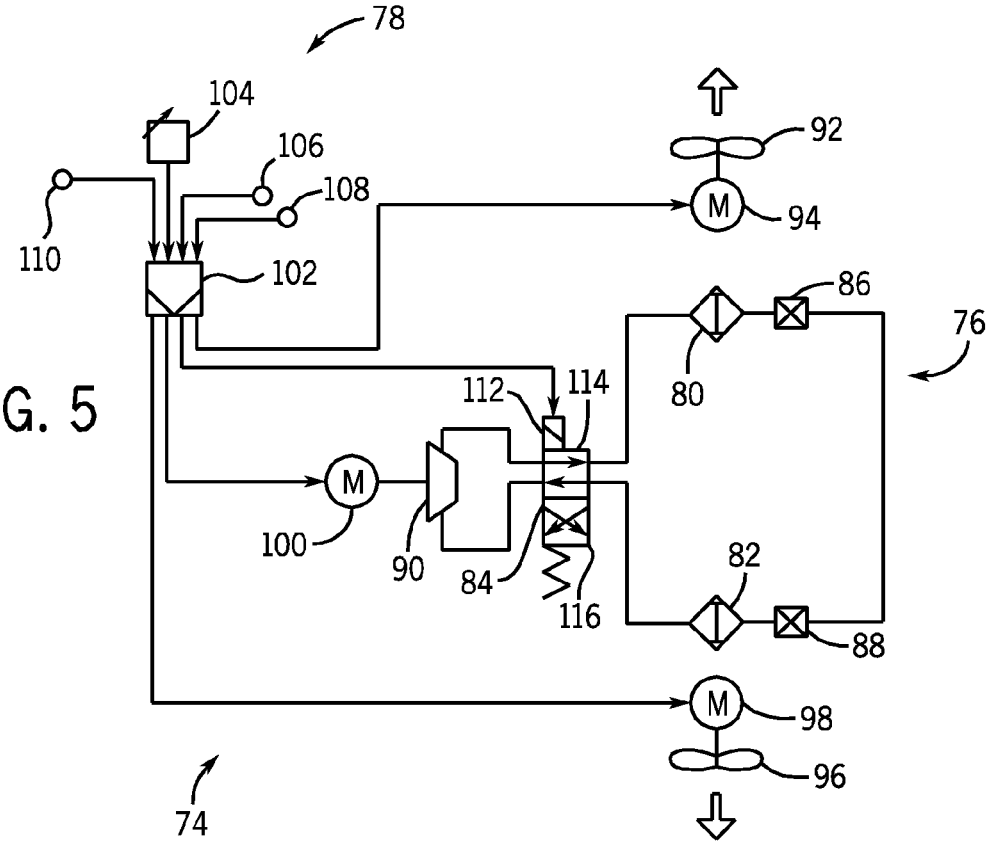
FIG. 5 is a diagrammatical overview of an exemplary heat pump system that may employ one or more heat exchangers.

FIG. 5 illustrates a heat pump system 74 that may employ multichannel tube heat exchangers. Because the heat pump may be used for both heating and cooling, refrigerant flows through a reversible refrigeration/heating loop 76. The refrigerant may be any fluid that absorbs and extracts heat. The heating and cooling operations are regulated by control devices 78.

Heat pump system 74 includes an outside coil 80 and an inside coil 82 that both operate as heat exchangers. The coils may function either as an evaporator or a condenser depending on the heat pump operation mode. For example, when heat pump system 74 is operating in cooling (or "AC") mode, outside coil 80 functions as a condenser, releasing heat to the outside air, while inside coil 82 functions as an evaporator, absorbing heat from the inside air. When heat pump system 74 is operating in heating mode, outside coil 80 functions as an evaporator, absorbing heat from the outside air, while inside coil 82 functions as a condenser, releasing heat to the inside air. A reversing valve 84 is positioned on reversible loop 76 between the coils to control the direction of refrigerant flow and thereby to switch the heat pump between heating mode and cooling mode.

Heat pump system 74 also includes two metering devices 86 and 88 for decreasing the pressure and temperature of the refrigerant before it enters the evaporator. The metering devices also regulate the refrigerant flow entering the evaporator so that the amount of refrigerant entering the evaporator equals, or approximately equals, the amount of refrigerant exiting the evaporator. The metering device used depends on the heat pump operation mode. For example, when heat pump system 74 is operating in cooling mode, refrigerant bypasses metering device 86 and flows through metering device 88 before entering inside coil 82, which acts as an evaporator. In another example, when heat pump system 74 is operating in heating mode, refrigerant bypasses metering device 88 and flows through metering device 86 before entering outside coil 80, which acts as an evaporator. According to other exemplary embodiments, a single metering device may be used for both heating mode and cooling mode. The metering devices typically are thermal expansion valves (TXV), but also may be orifices or capillary tubes.

The refrigerant enters the evaporator, which is outside coil 80 in heating mode and inside coil 82 in cooling mode, as a low temperature and pressure liquid. Some vapor refrigerant also may be present as a result of the expansion process that occurs in metering device 86 or 88. The refrigerant flows through multichannel tubes in the evaporator and absorbs heat from the air changing the refrigerant into a vapor. In cooling mode, the indoor air flowing across the multichannel tubes also may be dehumidified. The moisture from the air may condense on the outer surface of the multichannel tubes and consequently be removed from the air.

After exiting the evaporator, the refrigerant passes through reversing valve 84 and into a compressor 90. Compressor 90 decreases the volume of the refrigerant vapor, thereby, increasing the temperature and pressure of the vapor. The compressor may be any suitable compressor such as a screw compressor, reciprocating compressor, rotary compressor, swing link compressor, scroll compressor, or turbine compressor.

From compressor 90, the increased temperature and pressure vapor refrigerant flows into a condenser, the location of which is determined by the heat pump mode. In cooling mode, the refrigerant flows into outside coil 80 (acting as a condenser). A fan 92, which is powered by a motor 94, draws air across the multichannel tubes containing refrigerant vapor. According to certain exemplary embodiments, the fan may be replaced by a pump that draws fluid across the multichannel tubes. The heat from the refrigerant is transferred to the outside air causing the refrigerant to condense into a liquid. In heating mode, the refrigerant flows into inside coil 82 (acting as a condenser). A fan 96, which is powered by a motor 98, draws air across the multichannel tubes containing refrigerant vapor. The heat from the refrigerant is transferred to the inside air causing the refrigerant to condense into a liquid.

After exiting the condenser, the refrigerant flows through the metering device (86 in heating mode and 88 in cooling mode) and returns to the evaporator (outside coil 80 in heating mode and inside coil 82 in cooling mode) where the process begins again.

In both heating and cooling modes, a motor 100 drives compressor 90 and circulates refrigerant through reversible refrigeration/heating loop 76. The motor may receive power either directly from an AC or DC power source or from a variable speed drive (VSD). The motor may be a switched reluctance (SR) motor, an induction motor, an electronically commutated permanent magnet motor (ECM), or any other suitable motor type.

The operation of motor 100 is controlled by control circuitry 102. Control circuitry 102 receives information from an input device 104 and sensors 106, 108, and 110 and uses the information to control the operation of heat pump system 74 in both cooling mode and heating mode. For example, in cooling mode, input device 104 provides a temperature set point to control circuitry 102. Sensor 110 measures the ambient indoor air temperature and provides it to control circuitry 102. Control circuitry 102 then compares the air temperature to the temperature set point and engages compressor motor 100 and fan motors 94 and 98 to run the cooling system if the air temperature is above the temperature set point. In heating mode, control circuitry 102 compares the air temperature from sensor 110 to the temperature set point from input device 104 and engages motors 94, 98, and 100 to run the heating system if the air temperature is below the temperature set point.

Control circuitry 102 also uses information received from input device 104 to switch heat pump system 74 between heating mode and cooling mode. For example, if input device 104 is set to cooling mode, control circuitry 102 will send a signal to a solenoid 112 to place reversing valve 84 in an air conditioning position 114. Consequently, the refrigerant will flow through reversible loop 76 as follows: the refrigerant exits compressor 90, is condensed in outside coil 80, is expanded by metering device 88, and is evaporated by inside coil 82. If the input device is set to heating mode, control circuitry 102 will send a signal to solenoid 112 to place reversing valve 84 in a heat pump position 116. Consequently, the refrigerant will flow through the reversible loop 76 as follows: the refrigerant exits compressor 90, is condensed in inside coil 82, is expanded by metering device 86, and is evaporated by outside coil 80.

The control circuitry may execute hardware or software control algorithms to regulate heat pump system 74. According to exemplary embodiments, the control circuitry may include an analog to digital (A/D) converter, a microprocessor, a non-volatile memory, and an interface board.

The control circuitry also may initiate a defrost cycle when the system is operating in heating mode. When the outdoor temperature approaches freezing, moisture in the outside air that is directed over outside coil 80 may condense and freeze on the coil. Sensor 106 measures the outside air temperature, and sensor 108 measures the temperature of outside coil 80. These sensors provide the temperature information to the control circuitry which determines when to initiate a defrost cycle. For example, if either sensor 106 or 108 provides a temperature below freezing to the control circuitry, system 74 may be placed in defrost mode. In defrost mode, solenoid 112 is actuated to place reversing valve 84 in air conditioning position 114, and motor 94 is shut off to discontinue air flow over the multichannel tubes. System 74 then operates in cooling mode until the increased temperature and pressure refrigerant flowing through outside coil 80 defrosts the coil. Once sensor 108 detects that coil 80 is defrosted, control circuitry 102 returns the reversing valve 84 to heat pump position 116. As will be appreciated by those skilled in the art, the defrost cycle can be set to occur at many different time and temperature combinations.

FIG. 6 is a perspective view of an exemplary multi-slab heat exchanger that may be used in air conditioning system 40, shown in FIG. 4, or heat pump system 74, shown in FIG. 5. The exemplary multi-slab heat exchanger may be a condenser 46, an evaporator 52, an outside coil 80, or an inside coil 82, as shown in FIGS. 4 and 5. It should be noted that in similar or other systems, the heat exchanger may be used as part of a chiller or in any other heat exchanging application. The heat exchanger 118 includes two coil slabs 120 and 122 disposed side by side and adjacent to each other. The slabs 120 and 122 may be separated by a distance A that allows circulation of an external fluid, such as air, between the two slabs. The distance A may be adjusted to promote distribution of the external fluid across the rear slab 122. The gap between the two slabs, as defined by distance A, may allow circulation of the external fluid between the slabs, which may in turn promote a more even heat load across the slabs and reduce frost growth, particularly in outdoor heat pump applications. However, in certain embodiments, the distance A may be eliminated and the coil slabs 120 and 122 may be disposed immediately adjacent to each other.

Each slab 120 and 122 includes manifolds 124, 126, 128, and 130 that are connected by multichannel tubes 132. Specifically, slab 122 includes manifolds 124 and 126, and slab 120 includes manifolds 128 and 130. The manifolds and tubes may be constructed of aluminum or any other material that promotes good heat transfer.

Refrigerant enters heat exchanger 118 through an inlet 134 and exits heat exchanger 118 through an outlet 136. Within heat exchanger 118, refrigerant flows from manifold 124 through the multichannel tubes of slab 122 to manifold 126. The refrigerant then enters slab 120 thorough manifold 130, flows thorough the multichannel tubes of slab 120 to manifold 128, and exists through outlet 136. Although thirty tubes are shown in each slab in FIG. 6, the number of tubes may vary. In certain exemplary embodiments, the heat exchanger may be rotated approximately 90 degrees so that the multichannel tubes run horizontally between side manifolds. Furthermore, the heat exchanger may be inclined at an angle relative to the vertical. Although the multichannel tubes are depicted as having an oblong shape, the tubes may be any shape, such as tubes with a cross-section in the form of a rectangle, square, circle, oval, ellipse, triangle, trapezoid, or parallelogram. According to exemplary embodiment, the tubes may have a cross-sectional dimension ranging from 0.5 millimeters to 3 millimeters. It should also be noted that the heat exchanger may be provided in a single plane or slab, and may included bends, corners, contours, and so forth. As those skilled in the art will appreciate, the location of the inlet and outlet may vary depending on the system requirements. For example, the inlet and outlet may be disposed at various locations on the manifolds, may be disposed on the top manifolds, or may include a plurality of inlets and outlets.

Baffles 138 divide the top manifolds 126 and 130 into sections, thereby subdividing the multichannel tubes 132 of slabs 120 and 122 into eight groups of tubes in this embodiment. Baffles subdivide slab 122 into four tube groups that provide refrigerant to four sections 140, 142, 144, and 146 of manifold 126. Baffles 138 subdivide slab 120 into four tube groups that receive fluid from four sections 148, 150, 152, and 154 of manifold 130. The sections 140, 142, 144, and 146 of slab 122 are adjacent to and align with corresponding sections 148, 150, 152, and 154 of slab 120. According to certain exemplary embodiments, the number of tubes within each tube group may vary, as may the number of groups in each slab (i.e., fewer groups may be included, but typically each slab will include at least two groups).

Fluid connections 156, 158, 160, and 162 transmit refrigerant from slab 122 to slab 120 by connecting sections of manifold 126 to sections of manifold 130. The fluid connections may be constructed of aluminum, stainless steel flexible hosing, or other suitable material and are generally tubular members that may be brazed or otherwise joined to manifolds 126 and 130. The connections fluidly connect tube groups of slab 122 with tube groups of slab 120. The corresponding tube groups connected by the fluid connections may be aligned with and adjacent to each other. For example, connection 156 transmits refrigerant from section 140 of slab 122 to section 148 of slab 120. Connection 162 transmits refrigerant from section 146 of slab 122 to section 154 of slab 120.

The fluid connections also may join nonadjacent tube groups allowing refrigerant to flow through different portions of each slab. For example, connection 158 transmits fluid from section 142 to non-adjacent section 152. Connection 160 transmits fluid from section 144 to non adjacent section 150. As those skilled in the art will appreciate, any configuration of fluid connections may be used to transmit refrigerant between the slabs. For example, according to other exemplary embodiments, a fluid connection may connect section 146 to section 150. Furthermore, in certain embodiments, fluid connections may be used to transmit refrigerant to multiple sections. For example, a fluid connection may be used to transmit fluid from section 144 to sections 150 and 148. In certain exemplary embodiments, fluid connections may connect tube groups within the same slab. Furthermore, the number of connections and tube groups within each coil slab may vary.

An external fluid 164, such as air may flow through coil slabs 120 and 122. As air 164 flows through the slabs, heat may be transferred to and from multichannel tubes. Air 164 first contacts slab 120 and flows through fins 165 located between multichannel tubes 132 to promote the transfer of heat between the tubes and the environment. According to exemplary embodiments, the fins are constructed of aluminum, brazed or otherwise joined to the tubes, and disposed generally perpendicular to the flow of refrigerant. However, according to other exemplary embodiments, the fins may be made of other materials that facilitate heat transfer and may extend parallel or at various angles with respect to the flow of the refrigerant. The fins may be louvered fins, corrugated fins, or any other suitable type of fin.

After flowing through slab 120, the air flows within the gap between the slabs. The gap may promote mixing and/or circulation of the air 154, which may function to reduce frost growth on multichannel tubes 132, particularly in outdoor heat pump applications. The gap also may promote an even air distribution across second slab 122. After flowing through the gap, the air flows through fins 165 of slab 122, transferring heat between the tubes in the environment.

The rate of air flow may vary across each slab 120 and 122. For example depending on environmental conditions, such as location of the heat exchanger and proximity of other equipment, the air flow through the fins in sections 154 and 146 may be lower than the air flow through the fins in sections 144 and 152. It is intended that the fluid connections be configured to maximize the heat transfer by directing the flow of refrigerant to various air flow sections, thereby promoting a balanced heat load across each slab. For example, as shown in FIG. 6, the connections 158 and 160 transmit refrigerant to nonadjacent sections of each coil slab. In this manner, the refrigerant flowing through section 144, which may receive a lower relative air flow, is transmitted to section 150 where it may be subjected to a higher relative air flow. Refrigerant from section 158, which may receive a higher relative air flow is transmitted to section 152 where it may be subjected to a lower relative air flow. The locations of the connections may be adjusted to customize refrigerant flow within the heat exchanger depending on various environmental conditions. Further, in other exemplary embodiments, the direction of air flow 164 may be reversed. As shown in FIG. 6, heat exchanger 118 transmits refrigerant from slab 122 to slab 120 in a counter flow manner with respect to air flow 164. However, in certain embodiments heat exchanger 118 may be configured to receive air flow in the opposite direction with the air flow entering heat exchanger 118 through slab 122 and exiting through slab 120.

FIG. 7 depicts another exemplary embodiment of heat exchanger 118 that includes fluid connections between nonadjacent tube groups. Fluid connections 166, 168, 170, and 172 connect nonadjacent tube sections of slab 122 and slab 120. Specifically, connection 166 connects section 140 to section 150, connection 168 connects section 142 to section 148, connection 170 connects section 144 to section 154, and connection 172 connects section 146 to section 152. By connecting nonadjacent tube groups, refrigerant may flow within different transverse sections of heat exchanger 118. In other exemplary embodiments, the locations of the connections may vary. For example, a connection may connect section 146 to section 150.

FIG. 8 illustrates another configuration for a multi-slab heat exchanger that employs a double manifold 174. The double manifold receives tubes 132 from both the first slab 120 and the second slab 122. A divider 176 longitudinally divides double header 174 into two openings 178 and 180. The multichannel tubes of slab 122 are inserted into opening 178, and the multichannel tubes of slab 120 are inserted into opening 180. A baffle 182 divides each opening 178 and 180 and its corresponding tubes into two sections. Specifically, baffle 182 divides slab 122 into two tube groups connected to sections 140 and 142. Baffle 182 divides slab 120 into two tube groups connected to sections 148 and 150. Fluid connections 166 and 168 connect nonadjacent tube sections in a manner similar to that shown in FIG. 7. Specifically, connection 166 transmits fluid from section 140 to section 150, and connection 168 transmits fluid from section 142 to section 148. According to exemplary embodiments, the double manifold may provide additional support for the multi-slab heat exchanger as well as facilitate manufacturing. A double manifold also maybe be used to connect the coil slabs 120 and 122 at the other end of multichannel tubes 132.

FIG. 9 depicts a manifold 184 that may be used to fluidly connect tube groups within a multi-slab heat exchanger. A divider 186 is located inside manifold 184 to divide manifold 184 into two volumes, an upper volume 188 and a lower volume 190. The divider may be constructed of aluminum or other suitable material and brazed or otherwise joined to the manifold. The divider 186 may be interference fit, placed, or affixed within the manifold. The height of the divider may vary within the manifold. Multichannel tubes 132 extend into manifold 184 at different heights, such that certain tubes extend into upper volume 188 and other tubes extend into lower volume 190. Each volume 188 and 190 of manifold 184 allows fluid to flow between tube groups of slabs 120 and 122. In this manner, the manifold serves as the fluid connection between tube groups. As shown, a portion of divider 186 has been cut away to better illustrate the heights of multichannel tubes 132. Upper tubes 192 extend through lower volume 190, through divider 186, and terminate within upper volume 188. Lower tubes 194 extend and terminate within lower volume 190. Upper tubes 194 extend into manifold 184 at a distance F that is great enough to allow the tubes to extend through lower volume 190, through divider 186, and into upper volume 188. Slabs 120 and 122 each have a set of upper tubes 192. The upper tubes of slab 120 are nonadjacent to the upper tubes of slab 122. Within upper volume 190, fluid may flow from the upper tubes of slab 122, enter volume 188, and enter the upper tubes of slab 120, as shown generally by reference numeral 196. In this manner, refrigerant may flow within the upper volume to different sections within the coil slabs.

Slabs 120 and 122 each also have a set of lower tubes 194. The lower tubes of slab 120 are nonadjacent to the lower tubes of slab 122. Lower tubes 194 extend into manifold 184 at a height B that is smaller than height F. The smaller height B allows these tubes to extend and open into lower volume 190. Consequently, fluid may transfer from the lower tubes of slab 122 to the lower tubes of slab 120 within lower volume 190, as generally shown by reference numeral 198.

FIG. 10 is a front perspective view of manifold 184 shown in FIG. 9. Divider 186 separates manifold 184 into upper volume 188 and lower volume 190. Lower tubes 194 open into lower volume 190, while upper tubes 192 open into upper volume 188.

FIG. 11 is a side perspective view of manifold 184 shown in FIG. 9 sectioned through manifold 184. Lower tubes 194 extend into lower volume 190, while upper tubes 192 extend into upper volume 188. Divider 186 separates manifold 184 into the upper and lower volumes 188 and 190. According to certain exemplary embodiments, the configurations of the upper and lower tubes may vary. For example in certain exemplary embodiments, the lower tubes may be disposed adjacent to each other on different coil slabs, to allow transmission of fluid between adjacent tube groups. However, in other exemplary embodiments, such as the embodiment shown in FIG. 9, the lower tubes and upper tubes may be nonadjacent between coil slabs 120 and 122, to allow transfer of fluid between nonadjacent tube groups.

FIG. 12 depicts another multi-slab heat exchanger 200 that employs multichannel tubes that are bent to form two sections 202 and 204. Each section is in fluid communication with a manifold 124 and 128. Refrigerant enters manifold 124 through inlet 134 and flows through tube section 202. After flowing through tube section 202, the refrigerant enters a bent section 206. According to exemplary embodiments, the bent section may eliminate the need for manifolds on one end of the tubes. Bent section 206 connects tube sections 202 and 204. After traveling through bent section 206, the refrigerant flows through tube section 204 to manifold 128 and exists through outlet 136. According to exemplary embodiments, the bent section may be hot or cold formed during manufacturing of the multi-slab heat exchanger. The two sections 202 and 204 may be offset from each other by a distance D. According to exemplary embodiments, the distance D may be increased or decreased depending on space constraints, air flow patterns, and other operational considerations. In certain exemplary embodiments, the distance D may be configured to transfer refrigerant to different air flow sections within the multi-slab heat exchanger.

FIG. 13 is a detailed view of bent section 206 shown in FIG. 12. The bent section 206 separates tube section 202 from tube section 204 by a distance E. Distance E may be used to provide a gap between the tube sections to allow air distribution and circulation as the air flows between the tube sections. The bent section 206 includes two angular bends 208 and 210. The bends 208 and 210 include acute angles bent on perpendicular planes. The bends 208 and 210 are configured to laterally translate, or change, the position of flow paths 212 and 214 within the tube with respect to air flow 164. Each tube section includes a leading edge and a trailing edge. Specifically, section 204 includes a leading edge 216 contacted first by air flow 164. Air flow 164 flows across section 204 and contacts a trailing edge 218. Air flow 164 then flows across distance E and contacts a leading edge 220 of tube section 202. Air flow 164 flows across section 202 and contacts a trailing edge 220.

The flow paths 212 and 214 change positions between sections 202 and 204 with respect to the leading and trailing edges. Specifically, within tube section 204, flow path 212, indicated generally by the dashed line, is located near leading edge 216. In tube section 202, the same flow path 212 is located near trailing edge 222. Similarly, within tube section 204, flow path 214, indicated generally by the dotted and dashed line, is located near trailing edge 218. In tube section 202, the same flow path 214 is located near leading edge 220. The change in positions of flow paths 212 and 214 with respect to air flow 164 is intended to promote improved heat transfer by exposing each flow path to air flow near a leading edge and trailing edge. According to certain exemplary embodiments, the air flow rates and heat transfer rates may vary between the leading and trailing edges of a tube. For example, the air flow rate may be greater at the leading edge of a tube where the air has not encountered resistance as the air flows across the tube. Furthermore, the heat transfer may be greater at the leading edge of a tube where the temperature difference between the air and the refrigerant flowing within the tube may be the greatest.

FIG. 14 depicts an alternate tube configuration that may be used in the multi-slab heat exchanger shown in FIG. 12. Bent section 206 is formed from bend 208 and a bend 223. Bend 223 is disposed generally in the same plane as bend 208 and allows tube section 202 to be more closely aligned with tube section 204. Flow paths 212 and 214 again change positions between sections 202 and 204 with respect to the leading and trailing edges.

FIG. 15 shows another an alternate tube configuration that may be used in the multi-slab heat exchanger shown in FIG. 12. Instead of a bent section with two bends as shown in FIGS. 13 and 14, the tube in FIG. 15 includes a single bend 224. Bend 224 allows flow paths 212 and 214 to be disposed in the same position relative to the leading and trailing edges of each tube section. Specifically, within tube section 204, flow path 212, indicated generally by the dashed line, is located near trailing edge 218. In tube section 202, flow path 212 is also located near trailing edge 222. Similarly, in tube section 204, flow path 214, indicated generally by the dotted and dashed line, is located near leading edge 216. In section 202, flow path 214 also is located near leading edge 220. According to exemplary embodiments, bend 224 may be formed by hot or cold forming a multichannel tube after extrusion.

As shown in FIG. 16, many multi-slab heat exchangers 118 may be included in an HVAC&R system 226. The HVAC&R system, shown here as a chiller system, includes four sets of multi-slab heat exchangers 118. Fans 228 are located above heat exchangers 118 and draw air across heat exchangers 118. The heat exchangers 118 are disposed in a V-shaped configuration, which may provide increased heating and cooling capacity within a smaller footprint. A cabinet 232 located next to V-shaped configuration 230 may house equipment such as condensers, compressors, oil separators, motors, pumps, and controls for the HVAC&R system. The V-shaped configuration may allow heat exchanger slabs to be added or removed from the refrigeration system as needed based on capacity. For example, to increase capacity the number of heat exchangers 118 may be increased by adding additional modular sections.

FIG. 17 is a side view of V-shaped configuration 230 shown in FIG. 16. The fluid connections shown in FIGS. 6-11 may be used to connect slabs within V-shaped configuration 230. The left V-shaped configuration includes four coil slabs 234, 236, 238, and 240 inclined from the vertical to form a V-shape. Slabs 234 and 236 are located side-by-side to form one multi-slab heat exchanger and slabs 238 and 240 are located side-by-side to form another multi-slab heat exchanger. Baffles 138 divide each slab into sections and corresponding tube groups. Coil slabs 234 and 236 are divided into sections 140, 142, 148, and 150 that are connected by fluid connections 166 and 168 in a manner similar to that shown in FIG. 7. Connections 166 and 168 connect non adjacent sections within each slab.

Fluid connections also may be used to connect sections within the same slab. Coil slabs 238 and 240 are divided into sections 242, 244, 246, and 248. Fluid connections 250 and 252 connect sections within the same slab. Specifically, connection 250 connects sections 242 and 244 of slab 240, while connection 252 connects sections 246 and 248 of slab 238. The fluid connections may be generally tubular members formed from aluminum, stainless steel flexible hosing, or other suitable materials and may be brazed or otherwise joined to the slabs. According to exemplary embodiments, fluid connections also may be used to connect multi-slab heat exchangers in a series to form larger closed loops providing additional heating and cooling capacity for the system.

The right V-shaped configuration shows the interconnection of multi-slab heat exchangers using fluid connections. Coil slabs 254 and 256 form a multi-slab heat exchanger inclined at the vertical with respect to coil slabs 258 and 260 that form another multi-slab heat exchanger. Baffles 138 divide each slab into sections and corresponding tube groups. Slab 254 is divided into sections 262 and 264; slab 265 is divided in sections 266 and 268; slab 258 is divided into sections 270 and 272; and slab 260 is divided in sections 274 and 276. Fluid connections 276, 278, 280, and 282 fluidly connect sections of one multi-slab heat exchanger to sections of the other multi-slab heat exchanger. Connection 276 connects upper section 262 of outer slab 254 to lower section 272 of outer slab 258. Connection 278 connects upper section 266 of inner slab 256 to lower section 276 of inner slab 260. The connection of sections within different locations of the multi-slab heat exchanger (for example, upper sections to lower sections) is intended to promote increased heat transfer by distributing refrigerant between sections receiving different air flow rates.

The connectors also may be used to connect sections of an outer slab to sections of an inner slab. Connection 280 connects lower section 268 of inner slab 256 to upper section 270 of outer slab 258. Connection 282 connects lower section 264 of outer slab 254 to upper section 274 of inner slab 260. As those skilled in the art will appreciate, any combination of connections may be used to distribute refrigerant between sections and corresponding tube groups. For example, a system may include connections that fluidly connect sections within a single multi-slab heat exchanger, as shown by connections 168 and 166. A system also may include connections that fluidly connect sections between two or more multi-slab heat exchangers, as shown by connections 276, 278, 280, and 282. Furthermore, single or double manifolds, such as those shown in FIGS. 7 and 8 may be employed in the V-shaped configuration. Additionally, the fluid connections may be integrated into the manifolds using, for example, the manifolds shown in FIGS. 9 through 11.

The fluid connections also may be employed to connect single slab heat exchangers disposed in a V-shaped configuration, as shown in FIG. 18. Coil slabs 284, 286, 288, and 290 are disposed in V-shaped configuration 230. Baffles 138 divide each slab into sections and corresponding tube groups. The baffles may be used to divide a slab into any number of sections. Slab 284 is divided into two sections 292 and 294. Slab 286 is divided into three sections 296, 298, and 300. Slab 288 is divided into two sections 308 and 310, and slab 290 is divided into two sections 312 and 314.

The fluid connections may be used to connect sections within the same slab or to connect sections between different slabs. For example, connection 304 connects sections 294 and 292 located within the same slab 284. The fluid connections also may be used to connect one section to multiple sections. For example, section 294 is connected to section 292 by connection 304 and is also connected to section 300 by connection 302. The connections also may connect sections positioned in different locations within the V-shaped configuration. For example, connection 316 connects upper section 310 to lower section 312. Connection 18 connects lower section 308 to upper section 314. The configurations of connections, sections, and heat exchangers are shown for illustrative purposes and are not intended to be limiting. Any combination of the connection types shown may be used to connect sections and corresponding tube groups of single and multi-slab heat exchangers.

It should be noted that the present discussion makes use of the term "multichannel" tubes or "multichannel heat exchanger" to refer to arrangements in which heat transfer tubes include a plurality of flow paths between manifolds that distribute flow to and collect flow from the tubes. A number of other terms may be used in the art for similar arrangements. Such alternative terms might include "microchannel" and "microport." The term "microchannel" sometimes carries the connotation of tubes having fluid passages on the order of a micrometer and less. However, in the present context such terms are not intended to have any particular higher or lower dimensional threshold. Rather, the term "multichannel" used to describe and claim embodiments herein is intended to cover all such sizes. Other terms sometimes used in the art include "parallel flow" and "brazed aluminum". However, all such arrangements and structures are intended to be included within the scope of the term "multichannel." In general, such "multichannel" tubes will include flow paths disposed along the width or in a plane of a generally flat, planar tube, although, again, the invention is not intended to be limited to any particular geometry unless otherwise specified in the appended claims.

While only certain features and embodiments of the invention have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A multi-slab heat exchanger comprising:

a first slab of multichannel tubes subdivided into a first group of tubes and a second group of tubes;

a second slab of multichannel tubes subdivided into a third group of tubes and a fourth group of tubes; and a manifold in fluid communication with the first slab and the second slab and comprising a divider configured to subdivide the manifold into a first volume and a second volume, wherein the first group of tubes and the fourth group of tubes extend into the manifold through the first volume and the divider to terminate within the second volume, and wherein the second group of tubes and the third group of tubes extend into the manifold to terminate within the first volume.

2. The heat exchanger of claim 1, wherein the third group of tubes is aligned generally with the first group of tubes and the fourth group of tubes is aligned generally with the second group of tubes.

3. The heat exchanger of claim 1, wherein the third group of tubes is aligned generally with the second group of tubes and the fourth group of tubes is aligned generally with the first group of tubes.

4. The heat exchanger of claim 1, wherein the divider is disposed perpendicular to the multichannel tubes of the first slab.

5. The heat exchanger of claim 1, wherein the first group of tubes and the fourth group of tubes extend into the manifold at a first distance and wherein the second group of tubes and the third group of tubes extend into the manifold at a second distance smaller than the first distance.

6. The heat exchanger of claim 1, wherein the multi-slab heat exchanger is configured to direct a fluid from the first group of tubes through the second volume to the fourth group of tubes.

7. The heat exchanger of claim 1, wherein the multi-slab heat exchanger is configured to direct a fluid from the second group of tubes through the first volume to the third group of tubes.

8. The heat exchanger of claim 1, wherein the first and second slabs are separated by a gap to promote distribution of an external fluid flowing through the first and second slabs in a direction generally transverse to the first and second slabs.

9. A heating, ventilating, air conditioning or refrigeration system comprising:

a first multi-slab heat exchanger comprising a first inner slab of multichannel tubes and a first outer slab of multichannel tubes generally adjacent to the first inner slab;

a second multi-slab heat exchanger disposed non-adjacent and non-parallel to the second multi-slab heat exchanger and comprising a second inner slab of multichannel tubes and a second outer slab of multichannel tubes generally adjacent to the second inner slab; and a fluid connection configured to transmit fluid from the first inner slab to the second outer slab.

10. The heating, ventilating, air conditioning or refrigeration system of claim 9, wherein the first multi-slab heat exchanger and the second multi-slab heat exchanger are disposed in a V-shaped configuration, wherein the first inner slab is disposed downstream of the first outer slab with respect to an air flow, and wherein the second inner slab is disposed downstream of the second outer slab with respect to the air flow.

11. The heating, ventilating, air conditioning or refrigeration system of claim 9, wherein the fluid connection comprises a generally tubular member configured to fluidly connect the first inner slab to the second outer slab.

12. The heating, ventilating, air conditioning or refrigeration system of claim 9, wherein the fluid connection is configured to fluidly connect a first group of tubes disposed in the first inner slab to a second group of tubes disposed in the second outer slab, and wherein the first group of tubes are disposed in a different location than the second group of tubes with respect to an air flow.

13. The heating, ventilating, air conditioning or refrigeration system of claim 9, wherein the first inner slab is subdivided into a first group of tubes and a second group of tubes, wherein the second outer slab is subdivided into a third group of tubes generally aligned with the first group of tubes with respect to an air flow and a fourth group of tubes generally aligned with the second group of tubes with respect to the air flow, and wherein the fluid connection is configured to fluidly connect the first group of tubes to the fourth group of tubes.

14. The heating, ventilating, air conditioning or refrigeration system of claim 9, comprising an additional fluid connection configured to transmit fluid from the first outer slab to the second inner slab.

15. A heating, ventilating, air conditioning or refrigeration system comprising:

a first multi-slab heat exchanger comprising:

a first slab of multichannel tubes subdivided into a first group of tubes in a first location and a second group of tubes in a second location;

a second slab of multichannel tubes generally adjacent to the first slab, and subdivided into a third group of tubes aligned generally with the first group of tubes and a fourth group of tubes aligned generally with the second group of tubes; and a second multi-slab heat exchanger comprising:

a third slab of multichannel tubes subdivided into a fifth group of tubes in a third location corresponding to the first location with respect to an air flow and a sixth group of tubes in a fourth location corresponding to the second location with respect to the air flow;

a fourth slab of multichannel tubes generally adjacent to the first slab, and subdivided into a seventh group of tubes aligned generally with the fifth group of tubes and an eighth group of tubes aligned generally with the sixth group of tubes; and a first fluid connection configured to transmit fluid from the first group of tubes to the sixth group of tubes;

wherein the first multi-slab heat exchanger is non-adjacent and non-parallel to the second multi-slab heat exchanger.

16. The heating, ventilating, air conditioning or refrigeration system of claim 15, wherein the first multi-slab heat exchanger and the second multi-slab heat exchanger are disposed in a V-shaped configuration.

17. The heating, ventilating, air conditioning or refrigeration system of claim 15, wherein the fluid connection comprises a generally tubular member configured to fluidly connect manifolds of the first and second multi-slab heat exchangers.

18. The heating, ventilating, air conditioning or refrigeration system of claim 15, comprising a second fluid connection configured to transmit fluid from the second group of tubes to the seventh group of tubes.

19. The heating, ventilating, air conditioning or refrigeration system of claim 18, comprising a third fluid connection configured to transmit fluid from the third group of tubes to the eighth group of tubes and a fourth fluid connection configured to transmit fluid from the fourth group of tubes to the fifth group of tubes.

20. The heating, ventilating, air conditioning or refrigeration system of claim 15, comprising a second fluid connection configured to transmit fluid from the third group of tubes to the eighth group of tubes.

* * * * *